US006092477A

United States Patent [19]

Tsuta

[11] Patent Number: 6,092,477

[45] Date of Patent: Jul. 25, 2000

[54] PRESSER FOOT FOR SEWING MACHINE

[76] Inventor: Shigeharu Tsuta, 2-5-27, Nagata, Jooto-ku, Osaka, Japan

[21] Appl. No.: 09/354,369

[22] Filed: Jul. 14, 1999

[51] Int. Cl.[7] ..... D05B 29/06

[52] U.S. Cl. ..... 112/240

[58] Field of Search ..... 112/240, 235, 112/151, 60, 236, 237

[56] References Cited

U.S. PATENT DOCUMENTS

| | | | |
|---|---|---|---|
| 2,949,085 | 8/1960 | Schenkengel | 112/235 |
| 3,145,674 | 8/1964 | Kurihara | 112/240 |
| 4,183,311 | 1/1980 | Knowles | 112/235 |
| 5,090,344 | 2/1992 | Wang | 112/235 X |

*Primary Examiner*—Peter Nerbun
*Attorney, Agent, or Firm*—Moonray Kojima

[57] ABSTRACT

The invention relates to a presser foot for a sewing machine mounted on a presser bar of a sewing machine, for pressing a workpiece e.g. (cloth) supplied at a needle location to a feed dog, in which the presser foot is separated from the presser plate, and replaced with one selected from a plurality of types of presser feet suited to the sewing method, so that the sewing method or sewing width may be set or changed freely. Other parts are used commonly, and hence it is not required to replace the entire presser foot for the sewing machine, and the manufacturing cost is lowered. The presser foot is pressed to the cloth by the elasticity of the presser plate itself, and the cloth guide guides the cloth in the cloth feed direction.

4 Claims, 9 Drawing Sheets

PRESSER FOOT FOR SEWING MACHINE

BACKGROUND OF THE INVENTION

1. Field of the Invention

The present invention relates to a presser foot for sewing machine for use in chain stitch, lock stitch or other sewing jobs.

2. Description of the Prior Art

Hitherto, when pressing a workpiece by the above presser foot for sewing machine, as shown in FIG. 9, for example, a presser foot for sewing machine 21 is lowered vertically, a cloth E supplied at a needle location is pressed by a presser foot 24 attached to a clamp 22, to a feed dog D projecting to the upper surface of a throat plate C, but since a needle hole 24*d* formed in the presser foot 24 is set in the size, shape and needle width suited to the sewing method, when changing the sewing method and sewing width, the presser foot for sewing machine 21 must be replaced with one suited to the sewing method, and it takes time and labor in replacing work.

Yet, the presser foot for sewing machine 21 is assembled integrally with the clamp 22 and presser foot 24, plural types of presser foot for sewing machine 21 must be prepared corresponding to the sewing method and sewing width, and the manufacturing cost is high, and control or handling of parts is complicated.

SUMMARY OF THE INVENTION

It is hence a primary object of the invention to realize an arrangement for detaching and replacing only the presser foot for of a means comprising the presser foot for a sewing machine, and therefore when changing the sewing method, it saves time and labor for replacing the entire presser foot for the sewing machine, and other parts are used commonly and the total number of parts is smaller, so that the manufacturing cost may be lowered.

In another object of the invention, since a presser foot suited to the sewing machine is selected from a plurality of types of presser feet, the sewing method or sewing width may be changed and set freely.

In a different object of the invention, since the presser plate and presser foot are integrally fixed by fixing means a, drop of the presser foot or change of its position during sewing can be securely prevented, and the workpiece can be pressed securely in stable state.

In a further object of the invention, since a concave part and convex part are engaged with each other to fix the presser foot to the presser plate, it saves labor of fixing by a screw so that the presser foot can be detached and replaced easily and simply.

In a further different object of the invention, since the workpiece is guided in the cloth feed direction by a cloth guide, change of sewing position and sewing width of the workpiece can be prevented securely, so that the workpiece can be sewn in a specified sewing state accurately and neatly.

Other objects of the invention will be better understood from the following detailed description of the embodiments.

DESCRIPTION OF THE PREFERRED EMBODIMENTS

A preferred embodiment of the invention is described below while referring to the accompanying drawings.

Figure 1:
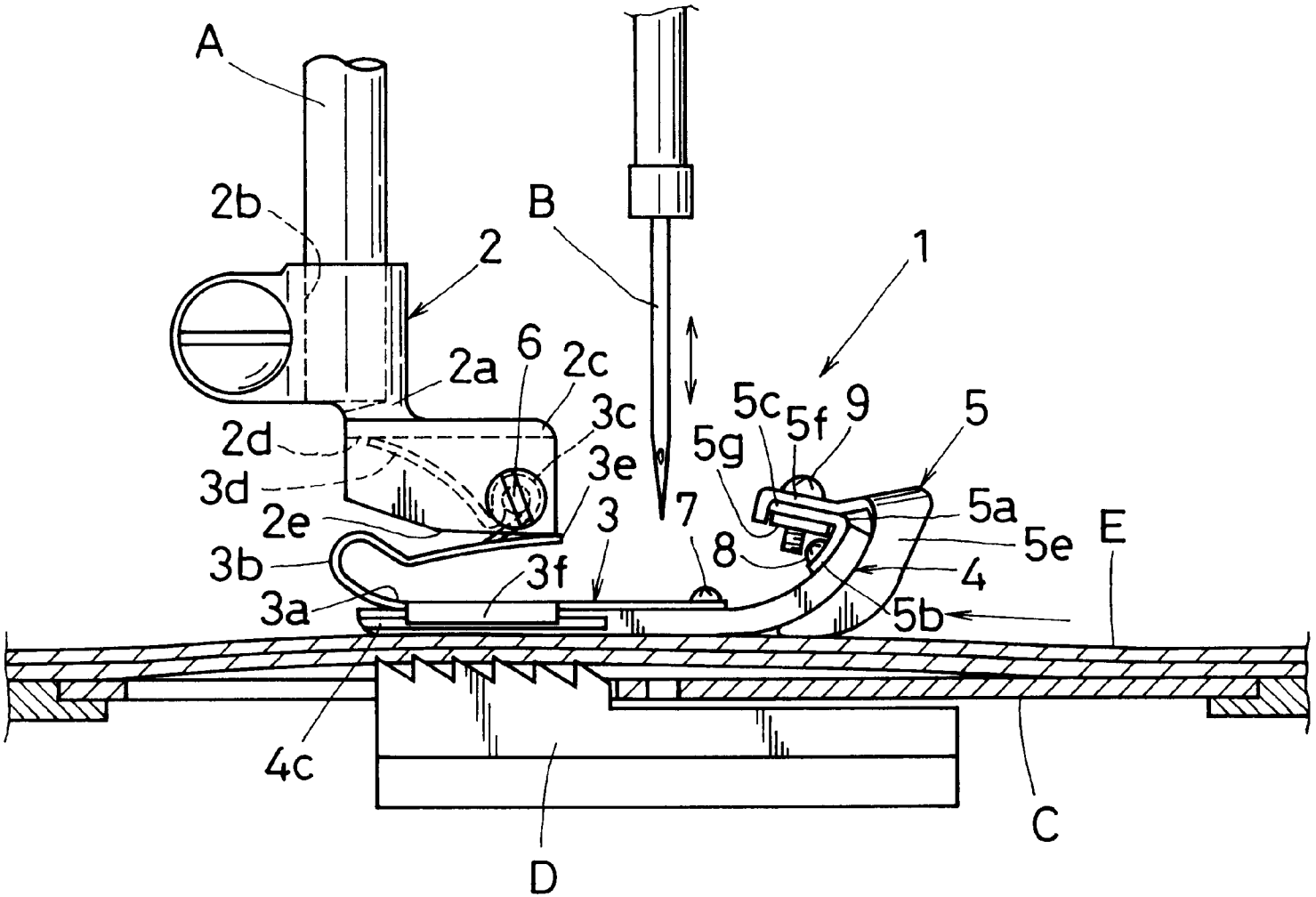
FIG. 1 is a side view showing a mounting state of a presser foot for sewing machine for chain stitch.

FIG. 1 shows a presser foot for sewing machine 1 used in stitch sewing of a cloth E of a workpiece, which is installed at the lower end of a presser bar A of a sewing machine (not shown) for chain stitch, and the cloth E supplied at the needle location immediately beneath a sewing machine needle B is pressed to a feed dog D projecting to the upper surface of a throat plate C.

Figure 2:
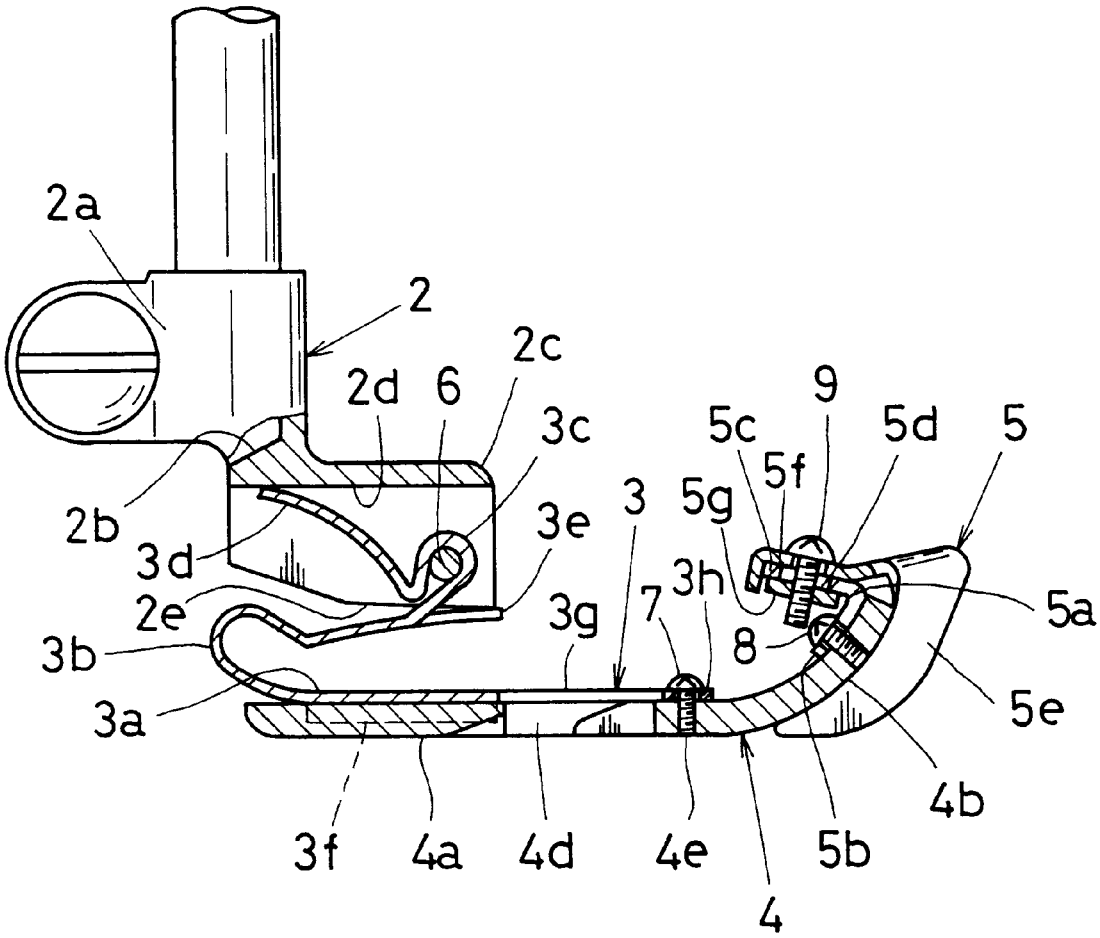
FIG. 2 is a longitudinal side view showing a mounting state of a presser foot.
Figure 3:
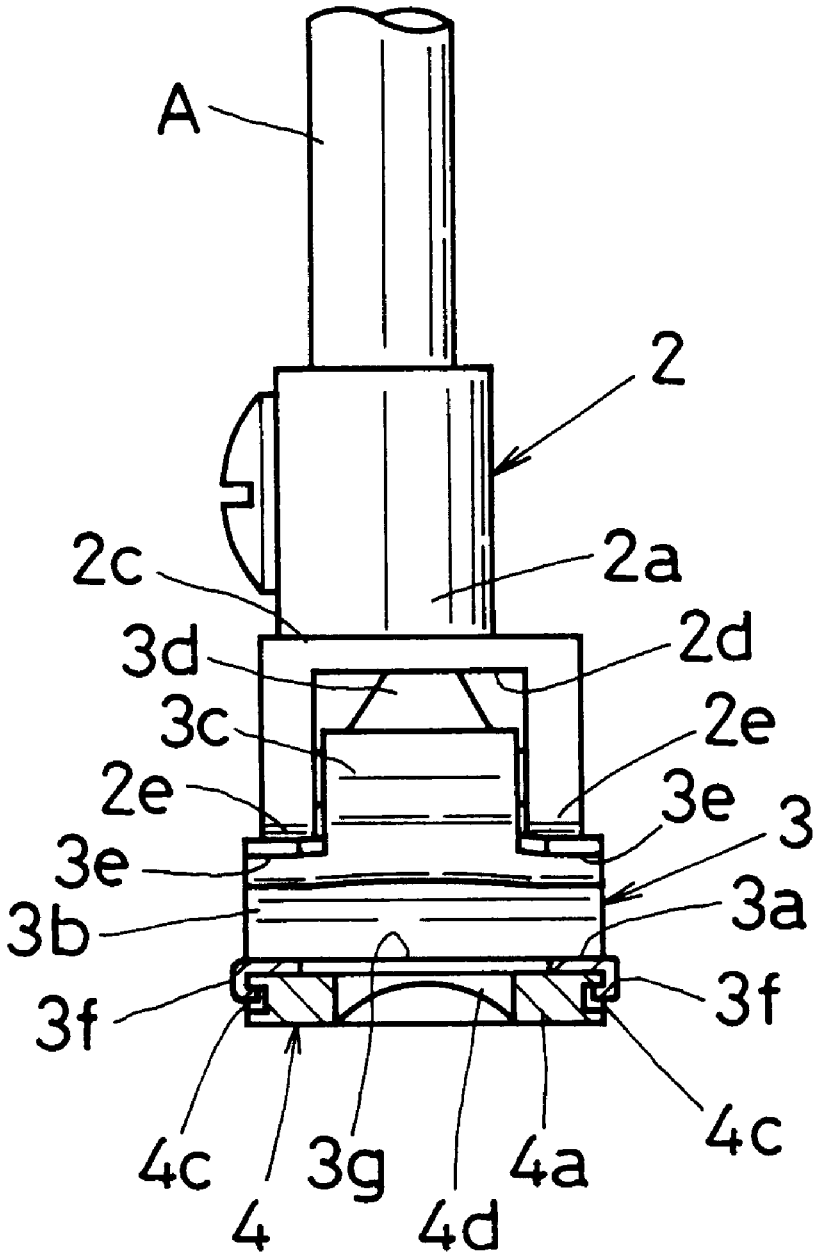
FIG. 3 is a longitudinal front view showing a mounting state of a presser foot.

The presser foot for sewing machine 1 is composed of, as shown also in FIG. 2 and FIG. 3, a set of clamp 2 and presser plate 3, a plurality types of presser (e.g. 5) of feet 4 setting the needle width of needle hole 4*d* mentioned below at arbitrary needle width sizes (for example, needle width of 3.2 mm, 4.0 mm, 4.8 mm, 5.6 mm, 6.4 mm), and a cloth guide 5 provided at the front end side of the presser foot 4.

The needle width of the needle hole 4*d* may be set, for example, at 3.2 mm or less or 5.6 mm or more.

The clamp 2 is formed, for example, by die-cast forming or cutting process, and the presser bar A is inserted and screwed into a shaft fixing portion 2*b* formed at the upper end side of a clamp main body 2*a*.

In a receiving portion 2*c* formed at the lower end side of the clamp main body 2*a*, a passing portion 3*c* and a spring portion 3*d* of the presser plate 3 mentioned below are inserted, and a screw 6 is passed through both side walls 2*e*, 2*e* of the receiving portion 2*c* and the passing portion 3*c* of the presser plate 3, and locked.

The spring portion 3*d* of a folding portion 3*b* abuts against the wall 2*d* of the receiving portion 2*c*, and the presser foot 3 is thrust in a direction of pressing the cloth E to the feed dog D by the elasticity of the presser plate 3 and the spring portion 3*d*.

The presser plate 3 is formed of a thin elastic metal plate, and the folding portion 3*b* formed at the rear end side of the main body 3*a* is folded and formed in a forward open form (for example, horseshoe form) by folding back almost horizontally the rear end side of the main body portion 3*a* to the forward direction.

The passing portion 3*c* formed nearly in the center of the folding portion 3*b* is folded and formed in a downward open form (for example, horseshoe form) for passing and allowing the screw 6 therein, by folding back the central portion of the folding portion 3*b* backward.

The spring portion 3*d* of the folding-back side abuts against the wall 2*d* of the receiving portion 2*c*, and support pieces 3*e* formed at both sides of the passing portion 3*c* abut against the lower end side of the wall 2*e*.

Detent claws 3*f* formed at both edges of the rear end side of the main body portion 3*a* are stopped in stopping grooves 4*c* formed at both side ends of the presser foot 4 mentioned later, and the presser foot 4 is held in an overlaid state (or slidable state) at the lower end side of the main body portion 3*a*.

On the other hand, a nearly square opening 3*g* formed in the middle of the front end side of the main body portion 3*a* is formed in a size and shape so that the needle hole 4*d* may be exposed almost entirely as the needle hole 4*d* of the presser foot 4 mentioned below is visible from the plane.

A hole 3*h* formed at the front end side of the main body portion 3*a* communicates with a hole 4*e* formed near the needle hole 4*d* of the presser foot 4, and a screw 7 is driven and fixed into the hole 4*e* through the hole 3*h*, and the opening 3*g* and needle hole 4*d* communicate with each other. The screw 7 driven into the hole 3*h* may be also fitted against the upper side of the presser foot 4.

The presser foot 4 is composed of a thick metal plate, and a round portion 4*b* formed at the front end side of the main body portion 4*a* is folded back in the specified radius of curvature obliquely upward, and is folded and formed in a curvature shape so that the cloth E may be pressed in easily.

The stopping grooves 4*c* formed at both side ends are formed in the groove width and groove depth for stopping the detent claws 3*f*, and are formed continuously along the side end portion of the main body portion 4*a*, and the rear end side is opened in a state for allowing insertion and removal of the detent claws 3*f*.

The needle hole 4*d* formed in the middle of the front end side of the main body portion 4*a* has a shape suited to chain stitch sewing, and is formed in a size and shape for allowing vertical motion (swing motion) of three needles B. The needle hole 4*d* may be also formed in a size and shape suited to other sewing method.

The cloth guide 5 is formed of a thin metal plate, and the support piece 5*b* formed at the front end side of the mounting plate 5*a* is overlaid at the upper side of the round portion 4*f*, and the overlaid portion is fixed by a screw 8. The support piece 5*b* may be also bonded and fixed (for example, fused and adhered) to the round portion 4*f*.

On the other hand, the guide plate 5*e* for guiding the cloth E is installed in a state projecting to the front side of the round portion 4*f*, and the support piece 5*f* formed at the upper end side of the guide plate 5*e* is stopped at the upper side of the support piece 5*c* formed at the rear end side of the mounting plate 5*a*, and opposite to the support piece 5*f*, the nut 5*g* is fitted to the lower side of the support piece 5*c*, and the support piece 5*f* and nut 5*g* are fixed by a screw 9 through a slot 5*d* formed in the support piece 5*c*, and the guide plate 5*e* is slidably provided in the slot 5*d*.

The guide plate 5*e* is curved at a radius of curvature nearly corresponding to the front side of the round portion 4*f*, and is formed in a smooth curve as seen from the side, so that the cloth E may be guided smoothly.

By thus constituted presser foot for sewing machine 1, the operation for pressing the cloth E is as described below.

First, as shown in FIG. 1, the presser foot for sewing machine 1 is vertically lowered, the presser foot 4 is pressed to the cloth E supplied at the needle location, and the cloth E is pressed to the feed dog D projecting to the upper surface of the throat plate C by the elasticity of the presser plate 3 itself and the spring 3*d*.

Next, driving the sewing machine (not shown), the cloth E is transferred in the cloth feed direction by the feed action of the feed dog D, and the sewing machine B is moved vertically to sew stitches. At the same time, the cloth E is guided in the cloth feed direction by the cloth guide 5. The cloth guide 5 may be also separated from the presser foot 4 during sewing operation.

Figure 4:
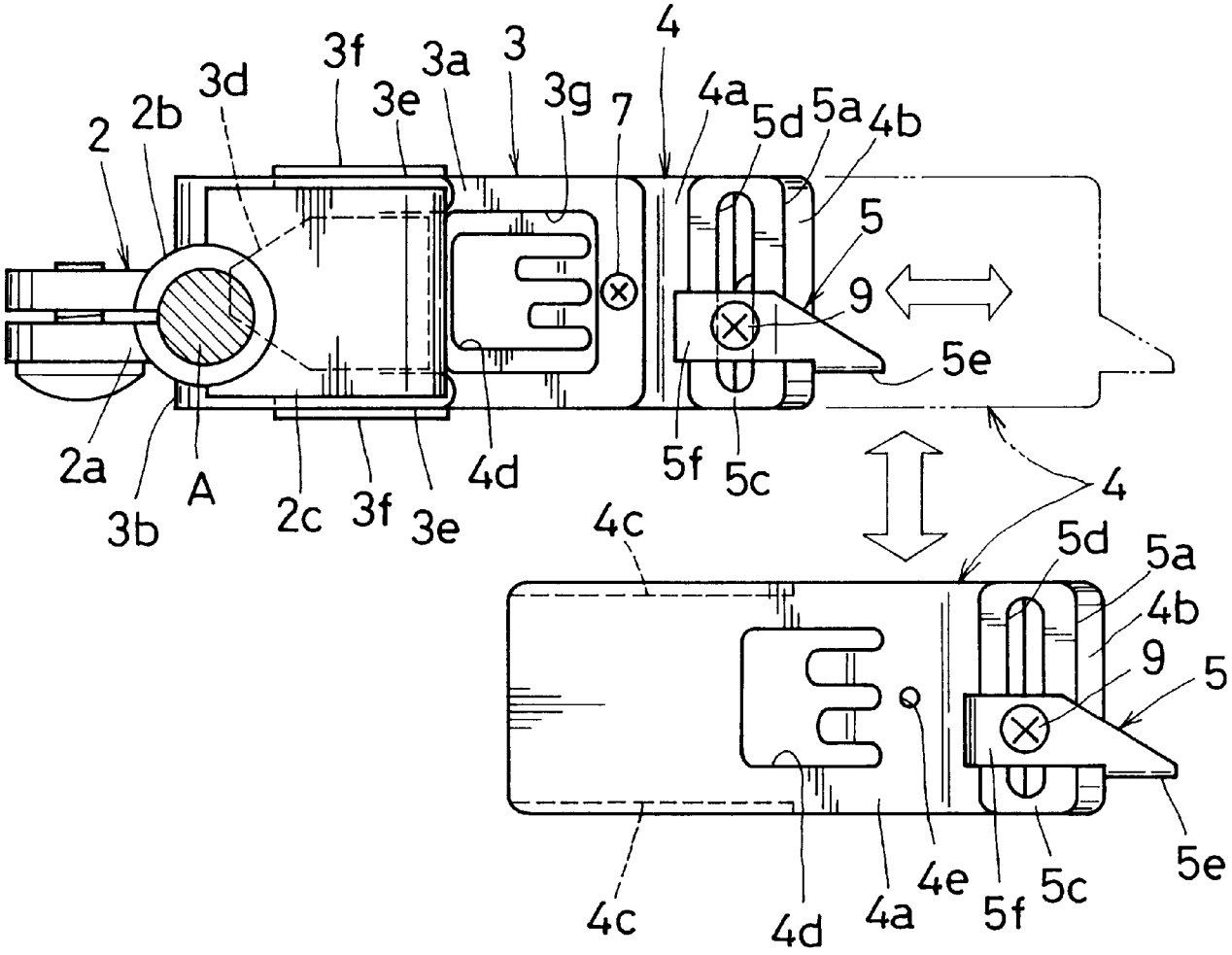
FIG. 4 is a plan view showing a detaching and attaching method of presser foot.

When changing the sewing width (needle width), as shown in FIG. 4, after clearing the fixing by turning the screw 7 by using a turning device (for example, Phillips screwdriver or ordinary screwdriver), the presser foot 4 is removed from the lower end side of the presser plate 3, and one presser foot 4 suited to the sewing method is selected from a plurality of types of presser feet 4 manufactured preliminarily.

The presser foot 4 is inserted from forward or fitted from beneath into the lower end side of the presser plate 3, the detent claw 3*f* of the presser plate 3 is fixed in the stopping groove 4*c* of the presser foot 4, and the hole 3*h* of the presser plate 3 and the hole 4*e* of the presser foot 4 communicate with each other and are fixed by the screw 7, and therefore the sewing width can be set and changed with a presser foot 4 of a desired size.

Thus, by separating the presser foot 4 from the presser plate 3 for composing the presser foot for sewing machine 1, since one presser foot 4 suited to the sewing method is selected from a plurality of types of presser feet 4 the sewing method or sewing width may be set and changed freely. In addition, when changing the sewing method, it saves time and labor for replacing the entire presser foot for sewing machine 1, and other parts are used commonly and the total number of parts is smaller, so that the manufacturing cost is lowered.

Further, by fixing the detent claw 3*f* of the presser plate 3 in the stopping groove 4*c* of the presser foot 4, since both are integrally fixed by the screw 7, drop of presser foot 4 or change of its position during sewing can be securely prevented, and the cloth can be pressed securely in stable state.

In addition, since the presser plate 3 itself is elastically deformed corresponding to the thickness of the cloth E, and an adequate pressing force is applied to the cloth E, the cloth E can be transferred securely and stably. Yet, it is not necessary to assemble another elastic part, and the entire assembling job can be done easily and simply.

Still more, since the cloth E is guided in the cloth feed direction by the cloth guide 5, change of sewing position and sewing width of the cloth E can be prevented securely, so that the cloth can be sewn in a specified sewing state accurately and neatly.

Figure 5:
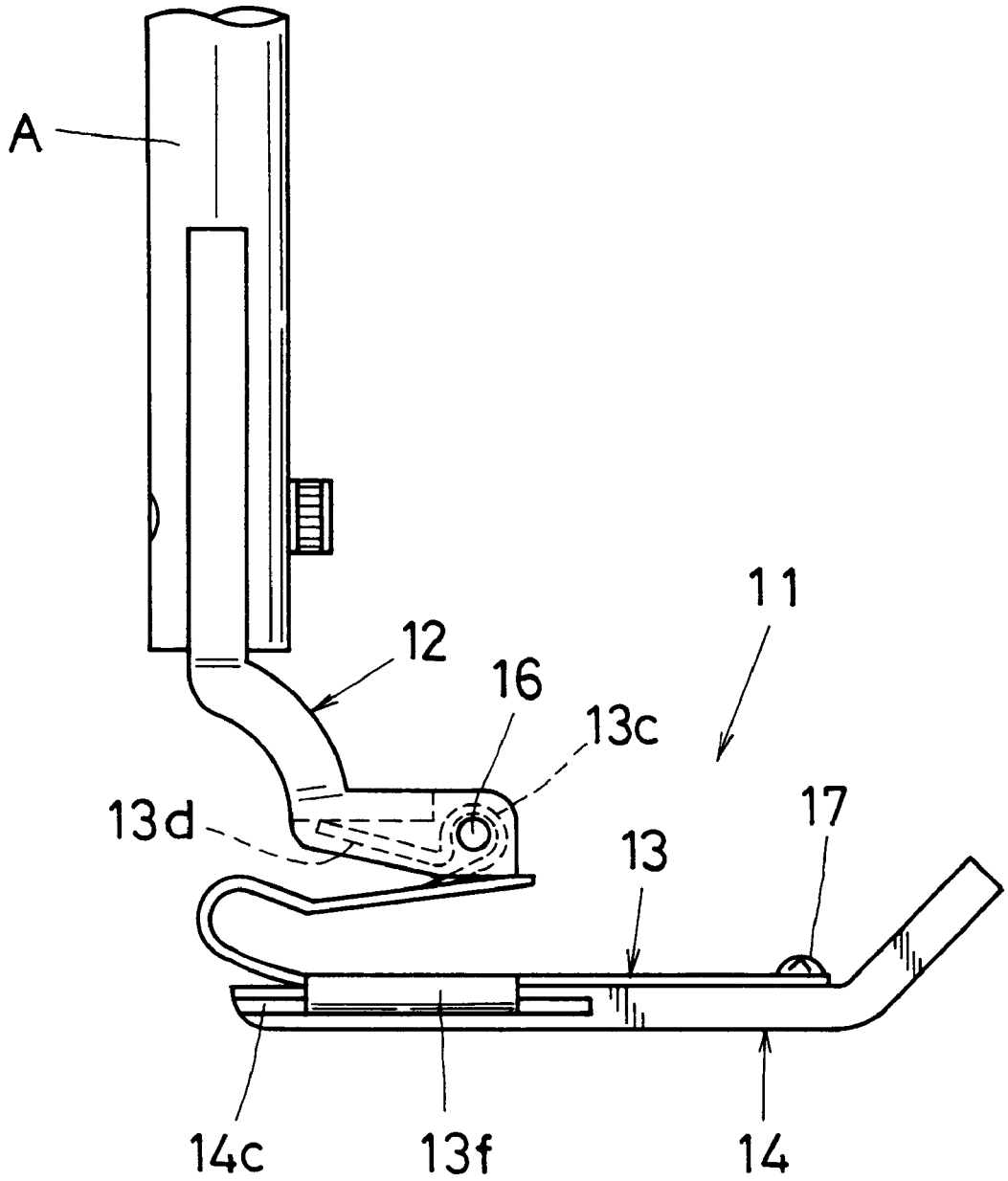
FIG. 5 is a side view showing a mounting state of a presser foot for sewing machine for lock stitch.
Figure 6:
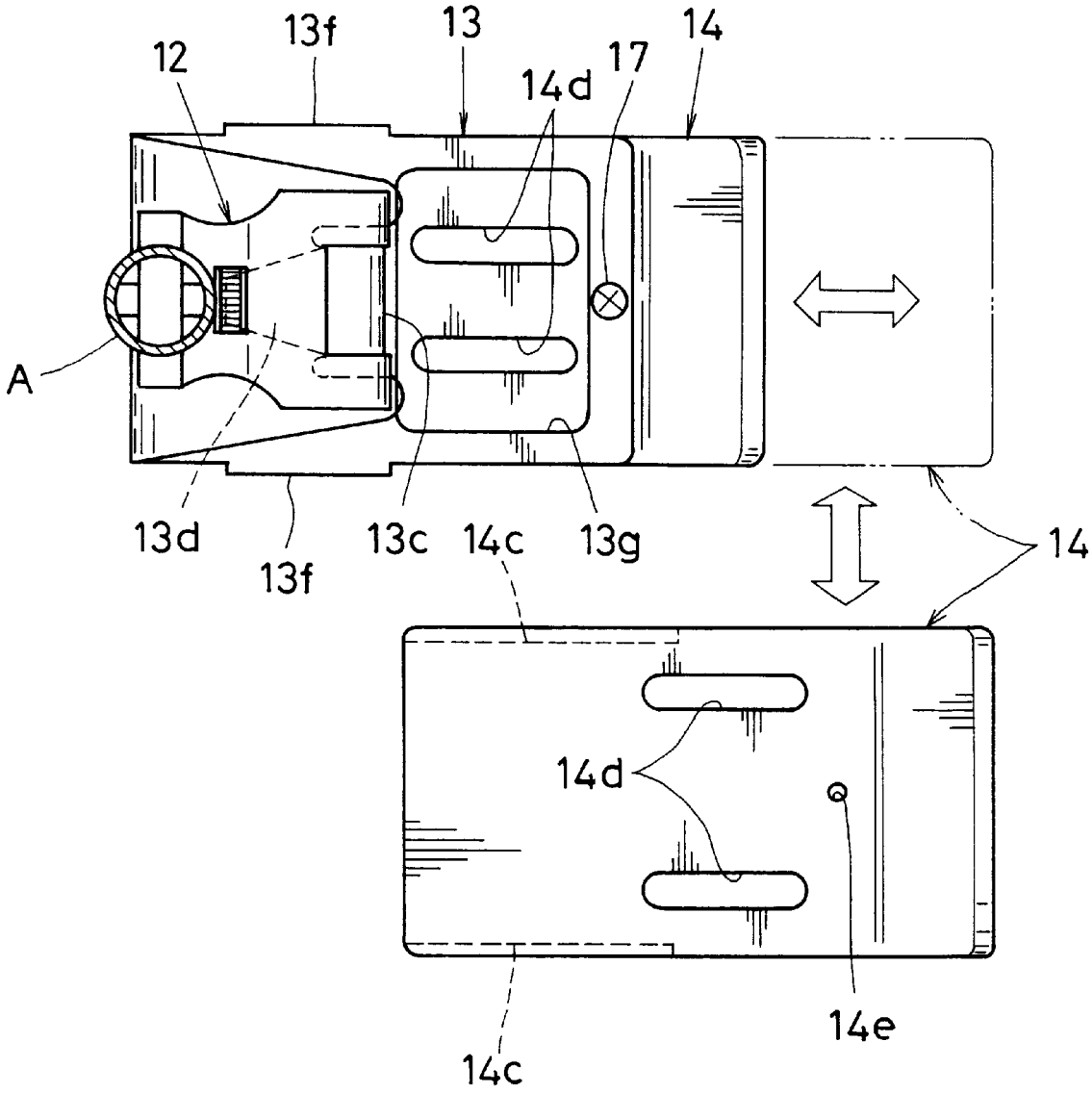
FIG. 6 is a plan view showing a detaching and attaching method of presser foot.

FIG. 5 and FIG. 6 show a presser foot for sewing machine 11 used in a lock stitch sewing machine (not shown), and it is composed of three sets of clamp 12 and presser plate 13, and a plurality (e.g. 14) of feet types of presser 14 set at desired needle width sizes corresponding to each set (for example, 1/16, 3/32, 1/8, 5/32, 3/16, 7/32, 1/4 inches, 9/32, 5/16, 11/32, 3/8, 13/32 inches, or 7/16, 1/2 inches).

Since the clamp 12 and presser plate 13 of the set corresponding to the sewing method and the presser foot 14 of arbitrary size corresponding to the set are combined, the same actions and effects as in the foregoing embodiment are obtained.

At the lower end side of the clamp 12, the passing portion 13*c* and spring portion 13*d* of the presser plate 13 are fixed with a screw 16, and a stopping groove 14*c* of the presser foot 14 is fixed in a detent claw 13*f* of the presser plate 13, and both are fixed with a screw 17.

Needle holes 14*d*, 14*d* of the presser foot 14 are formed parallel across an interval in a size, shape and length for allowing vertical motion of the sewing machine needle B through an opening 13*g* of the presser plate 13.

The cloth guide 5 may be formed on the presser foot 14, or the presser foot 14 may be changed to a desired size (for example, ⅙ or less or ½ or more).

Figure 7:
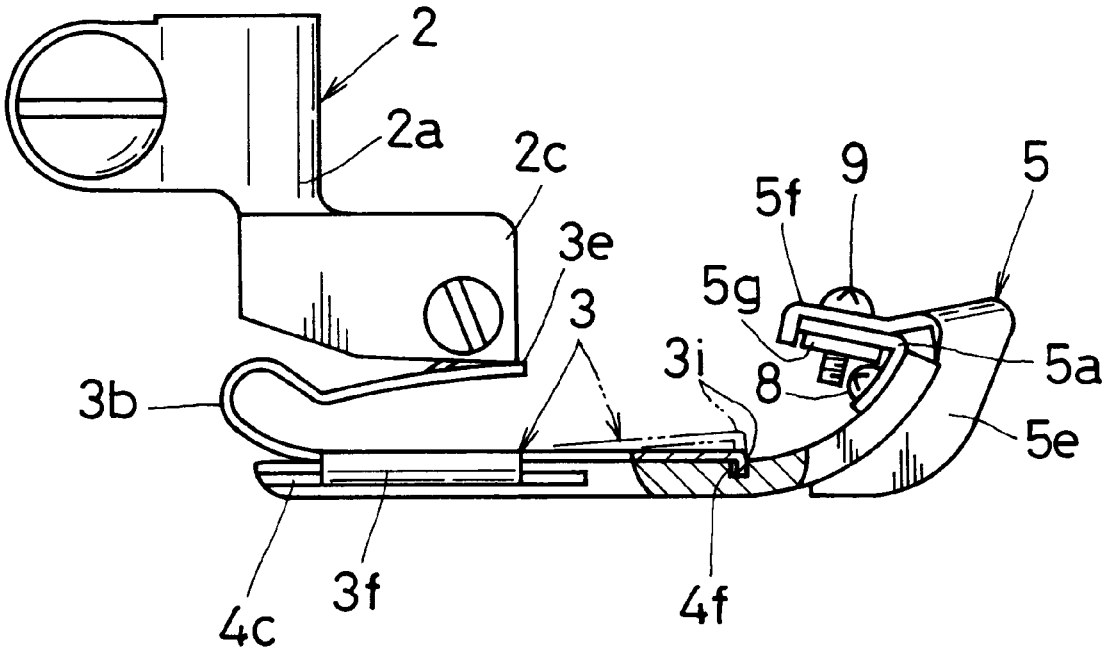
FIG. 7 is a side view showing a fixing method of presser foot.

FIG. 7 shows another fixing method of the presser foot 4, in which a convex portion 3*i* formed at the front end side of the presser plate 3 is fixed in a concave portion 4*f* formed near the needle hole 4*d* of the presser foot 4, and the presser foot 4 is overlaid and fixed at the lower end side of the presser plate 3.

Since the front end side of the presser plate 3 is flexible (indicated by virtual line in the drawing), and fixing of the convex portion 3*i* and concave portion 4*f* is cleared, it saves the labor of fixing with the screw 7 and clearing its fixing, so that the presser foot 4 may be detached and attached easily and simply. Incidentally, the screw 7 may be also used.

Figure 8:
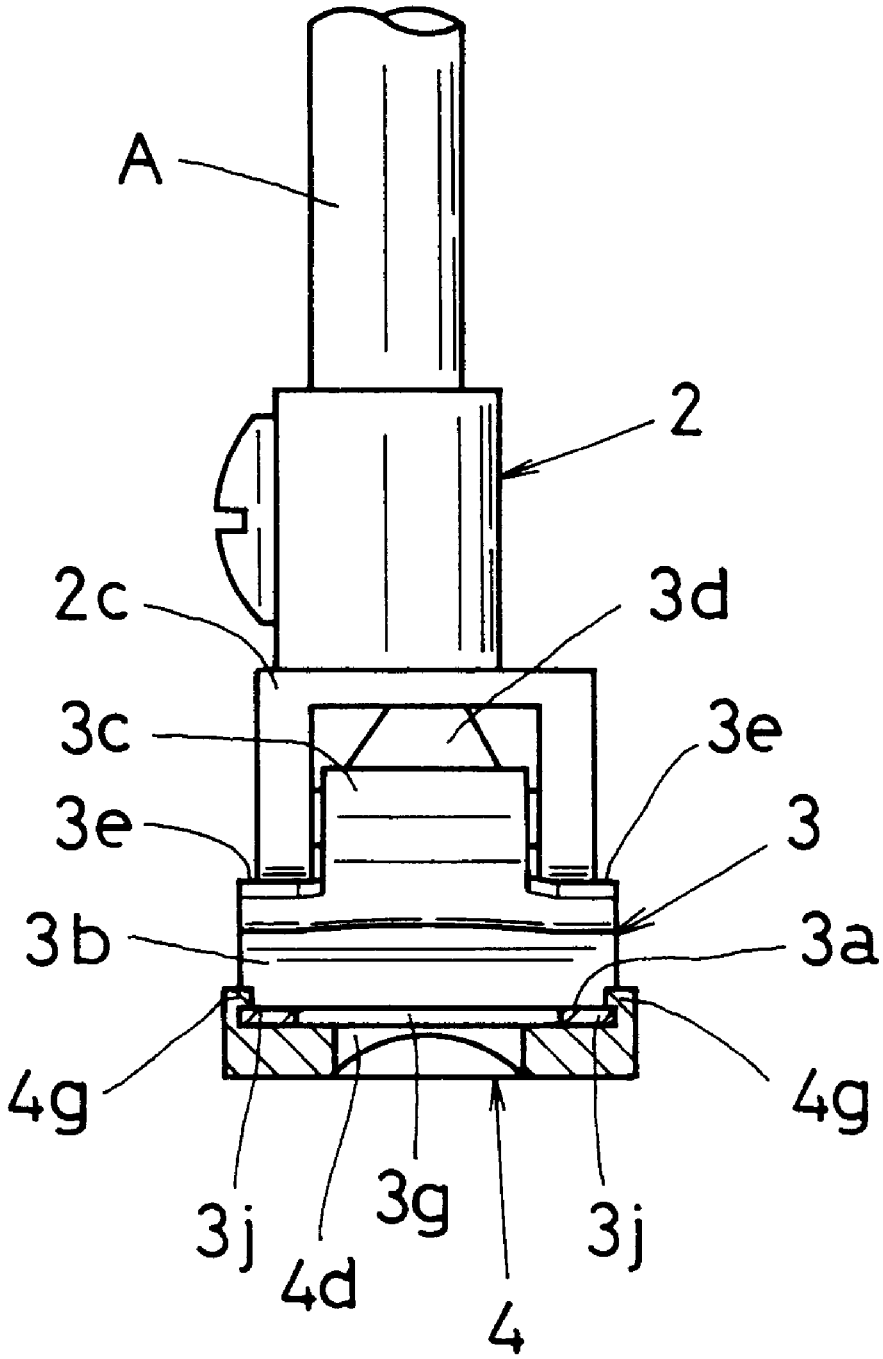
FIG. 8 is a longitudinal front view showing other fixing method of presser foot.
Figure 9:
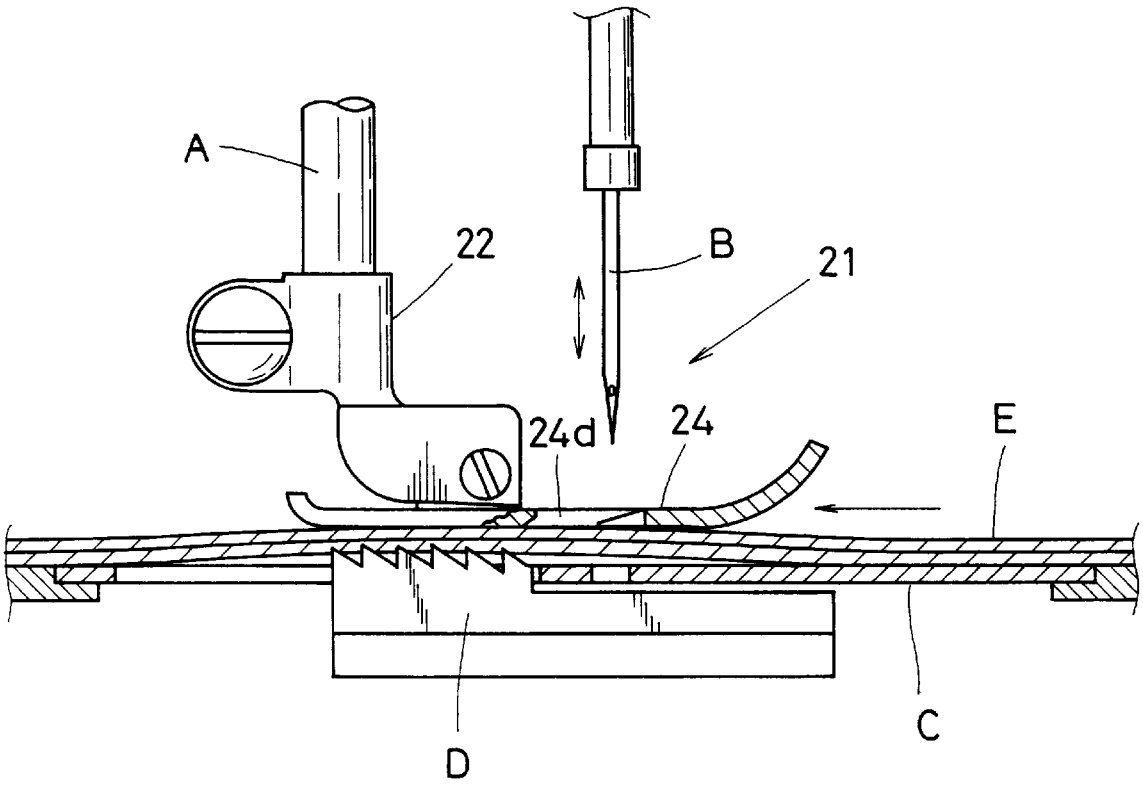
FIG. 9 (PRIOR ART)
FIG. 9 is a side view showing a mounting state of presser foot for sewing machine in a prior art.

FIG. 8 shows a further different fixing method, in which stopping portions 4*a* formed at both side edges of the presser foot 4 may be stopped (or fitted) and fixed in both side edges 3*j* of the presser plate 3. In this fixing method, the presser plate 13 and presser foot 14 may be fixed.

In the correspondence between the wording used to describe the invention and the disclosed embodiments, the workpiece of the invention corresponds to the cloth E of the embodiments, and similarly the fixing means corresponds to the screws 7, 17, detent claws 3*f*, 13*f*, convex portion 3*i*, stopping grooves 4*c*, 14*c*, concave portion 4*f*, and claw 4*g*, the convex portion corresponds to the detent claws 3*f*, 13*f*, convex portion 3*i*, and edge 3*j*, and the concave portion corresponds to the stopping grooves 4*c*, 214*c*, concave portion 14*f*, and stopping portion 4*g*, but the invention is not limited to the illustrated embodiments alone.

The presser plates 3, 13 may be formed in a common structure, and may be used commonly when fixing either one of the presser foot 4 or 14.

The pressing surface of the presser foot 4, 14 may be coated with a sliding member of a small contact resistance such as Teflon resin or silicone resin, or a sliding member formed in sheet or film may be adhered and fixed.

As other fixing method, alternatively, by exciting one or both of presser plate 3, 13 and presser foot 4, 15, they may be attracted and fixed by the magnetic force.

What is claimed is:

1. In a presser foot device for a sewing machine, comprising:

a vertical bar, a presser foot, and means for attaching said presser foot to said vertical bar, the improvement comprising:

said means for attaching comprising:

spring means;

means for connecting said spring means to said vertical bar;

a horizontal presser plate connected to said spring means; and detent claw means connected to sides of said presser plate; and said presser foot comprising a replaceable curved plate having a set of grooves on sides thereof for attachment to said detent claw means of said presser plate; whereby said presser foot is fixed to said presser plate by sliding said presser foot into engagement of said grooves thereof fit with said detent claw means of said presser plate so that said presser foot is easily replaced.

2. The device of claim 1, wherein said presser foot defines a screw hole, and said presser plate defines a screw hole aligned with said screw hole of said presser foot, and screw means fitted within said screw holes to attach said presser foot to said presser plate.

3. The device of claim 1, wherein said presser foot is selected according to a sewing method performed thereby.

4. The device of claim 1, further comprising a guide means disposed at a front end of said presser foot for guiding a cloth in a feed direction.

* * * * *